US005743458A

United States Patent [19]

French

[11] Patent Number: 5,743,458

[45] Date of Patent: Apr. 28, 1998

[54] STRETCHABLE GIFT WRAP

[76] Inventor: Judith A. French, 402 Lakeview Ave., Duluth, Minn. 55812

[21] Appl. No.: 735,555

[22] Filed: Oct. 23, 1996

[51] Int. Cl.[6] ..... B65D 65/22

[52] U.S. Cl. ..... 229/87.03; 383/67; 383/118; 150/154

[58] Field of Search ..... 383/41, 4, 71, 383/76, 82, 83, 88, 89, 118, 67; 150/154; 229/87.03, 89

[56] References Cited

U.S. PATENT DOCUMENTS

| | | | |
|---|---|---|---|
| 342,818 | 6/1886 | Biedinger | 229/89 |
| 415,134 | 11/1889 | Yocum et al. | 229/89 |
| 1,375,480 | 4/1921 | West | 150/154 |
| 2,035,384 | 3/1936 | Hinchliff . | |
| 2,711,234 | 6/1955 | Rubens | 383/118 X |
| 3,285,307 | 11/1966 | Dormaier | 383/76 X |
| 3,507,416 | 4/1970 | Douglas et al. | 150/154 X |
| 4,514,995 | 5/1985 | Curtis et al. | 150/154 X |
| 4,726,509 | 2/1988 | Fonas . | |
| 4,900,632 | 2/1990 | McGrath . | |
| 5,004,144 | 4/1991 | Selga . | |
| 5,325,986 | 7/1994 | Richardson et al. | 150/154 X |
| 5,407,125 | 4/1995 | Yates et al. . | |
| 5,450,965 | 9/1995 | Cox . | |
| 5,456,062 | 10/1995 | Wechsler . | |
| 5,529,395 | 6/1996 | French . | |

FOREIGN PATENT DOCUMENTS

| | | | |
|---|---|---|---|
| 5784400 | 6/1933 | Germany | 229/89 |

*Primary Examiner*—Jes F. Pascua

*Attorney, Agent, or Firm*—Richard C. Litman

[57] ABSTRACT

Various embodiments of stretchable gift wrap provide for the wrapping of a portion of a regularly or irregularly shaped article to provide an attractive and closely fitting wrap therefor. The wrap is preferably formed of a finely woven, generally opaque elastic fabric material adapted to stretch to substantially twice its unstretched dimension in all directions, such as a spandex material, although other stretchable materials may be used. In one embodiment, a flat sheet with a pair of opposite elastic bands is provided, which may be stretched over a gift or article to cover the upper portion thereof. Another embodiment comprises a flat sheet with a peripheral closure band which is used to draw the wrap tightly about an article. A third embodiment comprises a sleeve of stretchable material, which may be open at one or both ends. The sleeve may be used to wrap elongate articles (wine bottles, etc.) therein, with the corners of the closed end of the sleeve being folded and gathered to form an attractive configuration. The stretchable material used in each of the embodiments may be gathered by drawing together two separate points on the material and securing them together, to form a loop. The loop may be used for the attachment of trim articles (bows, ribbons, etc.) to the wrapped article. The wrapping material may be plain, or may be styled or decorated in any one of a number of patterns, as desired.

6 Claims, 7 Drawing Sheets

STRETCHABLE GIFT WRAP

BACKGROUND OF THE INVENTION

1. Field of the Invention

The present invention relates generally to sheet materials and methods used in covering various articles such as gifts and the like, and more particularly to a stretchable gift wrap which may be used to cover a part of or all of an object. The stretchable wrap may be formed as a flat sheet, or may be formed into a sleeve of material which may be stretched over elongate articles (e.g., wine bottles and the like, etc.). The stretchable nature of the material allows it to be gathered at one or more points to form one or more loops for holding trim. Generally opaque, stretchable fabrics having a close weave, such as spandex, have been found to work well, but other stretchable materials may be used.

2. Description of the Prior Art

The decorative covering or concealing of various articles, particularly gifts to be given at special occasions, is a long standing tradition. Typically, such gifts are wrapped using a non-stretchable sheet of decorated paper, with or without a bow or other trim secured thereto in some way.

While the wrapping of a rectangularly shaped article is relatively straightforward, it nevertheless requires a certain amount of skill in trimming the wrapping material to the proper size, making all folds neatly, and avoiding wrinkling the wrapping material to provide a smooth finish for the wrapped article. However, many articles are not rectangular, and/or are not packaged in a rectangular container. Such irregularly shaped articles are quite difficult to wrap neatly using conventional gift wrapping paper, even for the most skilled and accomplished person.

Moreover, such gift wrap is invariably taped or otherwise permanently secured to the wrapped article, and/or to itself, during the wrapping process. This renders even the sturdiest of wrapping papers unusable after a single use, as they must be torn to remove them from the package. Even if they are not torn, the creases from the original wrapping would render such sheets unusable for subsequent gift wrappings in any case.

Accordingly, a need will be seen for a stretchable gift wrap which is able to conform to a wide variety of differently shaped gifts and articles. The wrap may provide coverage for all but a portion of the concealed bottom of the article, or may be adapted to extend over only a portion of the top and upper sides. Preferably, a generally opaque and closely woven stretch fabric material, such as spandex, is used, but other stretchable sheet materials may be used as desired. A discussion of the prior art of which the present inventor is aware, and its differences from the various embodiments of the present invention, is provided below.

U.S. Pat. No. 2,035,384 issued on Mar. 24, 1936 to Ralph Hinchliff describes a Textile Jacket For Household Utensils And Other Articles. The jacket in its various embodiments generally comprises a knit sleeve of fabric material, which is adapted to be passed about the base of a wine glass, tumbler, bottle, or other household article. The material does not provide the uniformity of elasticity of the present stretchable gift wrap, however, as Hinchliff includes additional elastic means (i.e., rubber strands) woven into each of the embodiments to provide the required fit around the peripheries of the various articles to which the various jacket embodiments are applied. Each of the Hinchliff jackets are essentially sleeves, open at each end with an elastomer band therearound, unlike the single sleeve embodiment of the present invention having opposite open ends, wherein one end must be folded to form a partial or complete closure. Moreover, Hinchliff fails to disclose any form of decorative attachment means for any of his jackets, as provided by various embodiments of the present invention.

U.S. Pat. No. 4,726,509 issued on Feb. 23, 1988 to Kenneth R. Fonas describes Gift Wrapping comprising a complete box having a plurality of slots in the top thereof. A specially formed decoration includes tabs adapted to engage the slots of the box top. No stretchable fabric or other material is disclosed by Fonas, and his box forms a complete container for a gift or other article therein, unlike the stretchable cover of the present invention, which is adapted to cover a part of or the majority of a gift or article, and which may be open over some part of the bottom, sides, and/or top of the gift or article. Moreover, the Fonas wrap requires that the decoration be added to the top of the box, as failure to add decoration results in the unsightly slots in the top of the box being visible. The present stretchable gift wrap provides an attractive package whether an attachment for further decoration is formed, or not.

U.S. Pat. No. 4,900,632 issued on Feb. 13, 1990 to Paul F. McGrath describes a Decorative Multi-Loop Device comprising a specially formed bow blank and a retainer for the center of the bow to hold the shape of the bow. No gift wrap or other container is disclosed by McGrath.

U.S. Pat. No. 5,004,144 issued on Apr. 2, 1991 to Betty J. Selga describes a Reusable Fabric Gift Wrap using hook and loop fastening material to secure the wrap about an article. No stretch material is disclosed by Selga, and no disclosure is made of only partial wrapping of an article while leaving a portion (e.g., a part of the bottom) exposed, as is done by the present invention.

U.S. Pat. No. 5,407,125 issued on Apr. 18, 1995 to Helen Yates et al. describes Reusable Gift Wrapping formed of a fabric material and including areas of hook and loop material to provide for the closure thereof. No stretch material is disclosed, and Yates et al. admit that any particular sheet of material would be quite limited as to the dimensions of an article to be wrapped therein, due to the specific placement of the hook and loop material on the sheet. The Yates et al. wrapping is also intended to enclose an article completely therein, whereas the present stretchable gift wrap may leave a portion of the contained gift or article, or container therefor, exposed.

U.S. Pat. No. 5,450,965 issued on Sep. 19, 1995 to Kenneth L. Cox describes a Stretch-Wrapped Packaged Assembly, wherein a conventional elongate sheet of transparent plastic wrapping material is wound around a specially formed container. The edges of the finished wrap serve to grip the upper and lower edges of the container to secure the container together. The material is not suitable for use as gift wrap, due to its transparency which would allow the contents to be viewed while still wrapped. Moreover, the present stretch gift wrap is adapted to cover a gift using a single sheet, rather than continuous spiral wraps as disclosed in the Cox patent.

U.S. Pat. No. 5,456,062 issued on Oct. 10, 1995 to Lana Wechsler describes a Decorative Package Wrap comprising hosiery netting, similar to that used in the manufacture of women's stockings. Wechsler consistently describes the material as "hosiery netting" throughout her entire disclosure. The word "net" is defined as "openwork fabric" in Webster's II New Riverside University Dictionary, thus indicating that Wechsler is not interested in providing an opaque cover for a gift or other article wrapped within her net wrapping. The present stretchable gift wrap is preferably a generally opaque material of a much finer and closer weave than hosiery netting, in order to preclude visibility of the enclosed gift to any great extent until the wrap is removed. Moreover, Wechsler specifically describes her net wrapping as comprising a tubular length of material which is closed on each end to secure it about an article. The present stretchable gift wrap may comprise a sleeve which is closed at one end, but the sleeve remains at least partially open at the opposite (e.g., bottom) end of the article wrapped therein.

Finally, U.S. Pat. No. 5,529,395 issued on Jun. 25, 1996 to Judith A. French describes Stretchable Gift Wrapping With Self Forming Bow. The patent is directed to a flat, planar, stretchable sheet of material having a decorative border thereabout, which forms a decorative topping for an article placed within the wrap when the wrap is gathered about the article. No disclosure of any sleeve means, having either one or both ends open, nor any means of gathering a portion of the stretchable material to form a loop for the attachment of a decorative element therewith, is disclosed by the French '395 patent.

None of the above inventions and patents, taken either singly or in combination, is seen to describe the instant invention as claimed.

SUMMARY OF THE INVENTION

Accordingly, it is a principal object of the invention to provide improved stretchable gift wrap formed of finely woven, generally opaque elastic fabric material adapted to stretch to substantially twice its unstretched dimension in all directions, and preferably formed of a spandex fabric material.

It is another object of the invention to provide improved stretchable gift wrap which may be formed as a sheet including elastic bands extending therefrom and adapted to cover the upper portion of a gift or article, or which may be formed as a sleeve having one or both ends open and adapted to wrap stretchably about an elongate article.

It is a further object of the invention to provide improved stretchable gift wrap which may be stretchably gathered to form a loop in the wrapping material, for the holding or securing of an article of trim thereto.

An additional object of the invention is to provide improved stretchable gift wrap which sleeve embodiment may be folded about a narrower portion of an article therein, such as the neck of a bottle, to provide further trim for the wrap and article therein.

Still another object of the invention is to provide improved stretchable gift wrap which may cover the majority of a gift or article wrapped therein, but which may leave exposed a portion of the article wrapped therein.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to various embodiments of stretchable wrapping material for the wrapping of gifts and other articles, with the wrapping material of each embodiment being formed of finely woven, generally opaque elastic fabric material adapted to stretch to substantially twice its unstretched dimension in all directions. Spandex material is preferred, but other woven and non-woven stretchable materials may be substituted.

Figure 1:
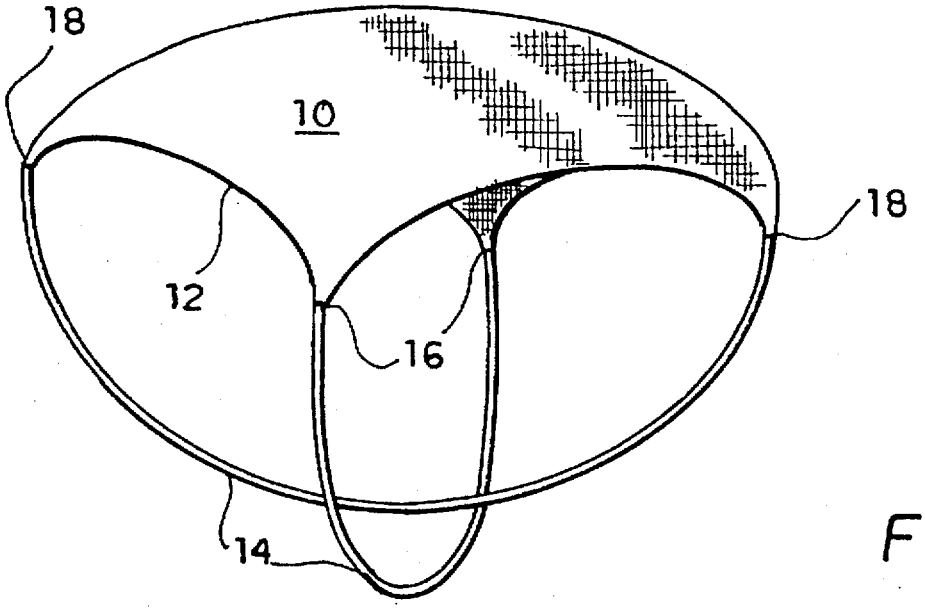
FIG. 1 is a perspective view of a first embodiment of the present stretchable gift wrap in its unstretched state, showing the general features and attachment means therefor.
Figure 2:
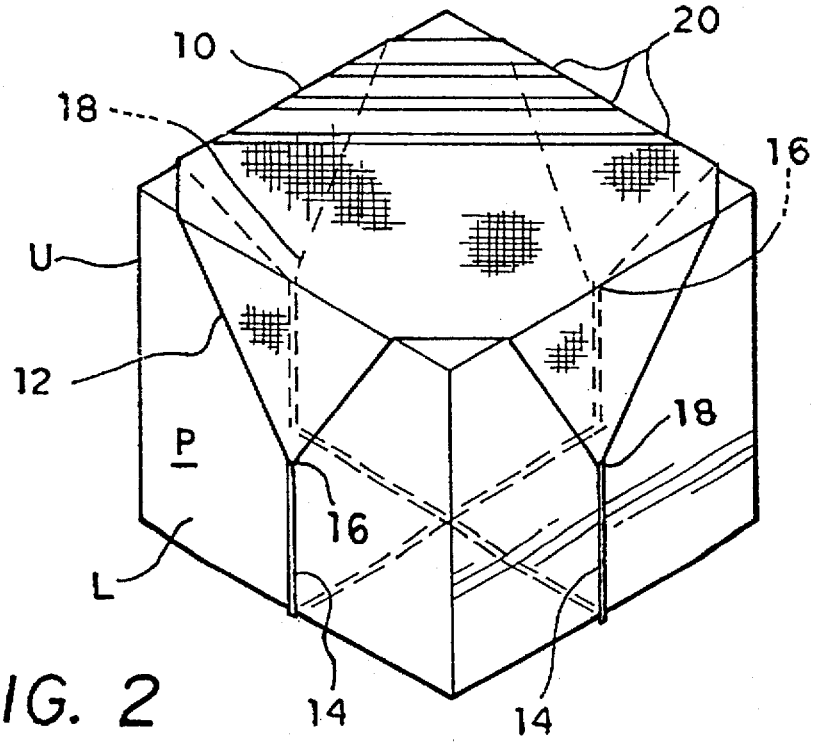
FIG. 2 is a perspective view of the gift wrap of FIG. 1, showing it in a distended state wrapped about the upper portion of a generally rectangular article.

FIGS. 1 and 2 disclose a first embodiment of the present stretchable gift wrap, comprising a generally rectangular gift or article topping sheet 10 of the material. The topping sheet 10 has a periphery 12 with a pair of elastic straps 14 each secured to diagonally opposite corners or points 16 and 18 of the sheet 10 and extending beneath the sheet 10. (It will be seen that the present embodiment is not limited to square or rectangular shapes, nor to a pair of elastic straps, but may be formed in any of a number of planar geometric shapes, with sufficient straps to provide a smooth fit over a package P or other article when the sheet 10 is applied thereto.) The topping sheet 10 may have a uniform color, or may have some form of geometric or other decorative pattern 20 thereon.

The straps 14 are adapted to stretch elastically about the lower portion L of a package P or other article, as shown in FIG. 2. With the stretching of the stretchable topping sheet 10, along with the stretch of the elastic straps 14, the present topping sheet 10 will conform smoothly and closely to the upper portion U of the package P to provide a decorative cover for the top thereof.

Figure 3A:
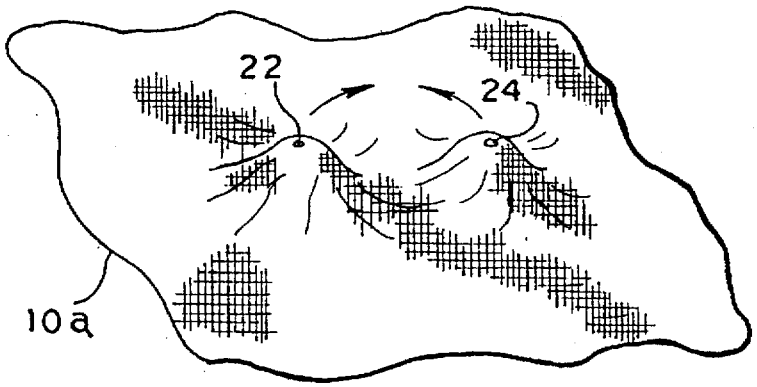
FIG. 3A is a fragmented perspective view of a portion of the present stretchable gift wrap, showing the drawing of two separated portions together in a first step in forming a trim attachment.
Figure 3B:
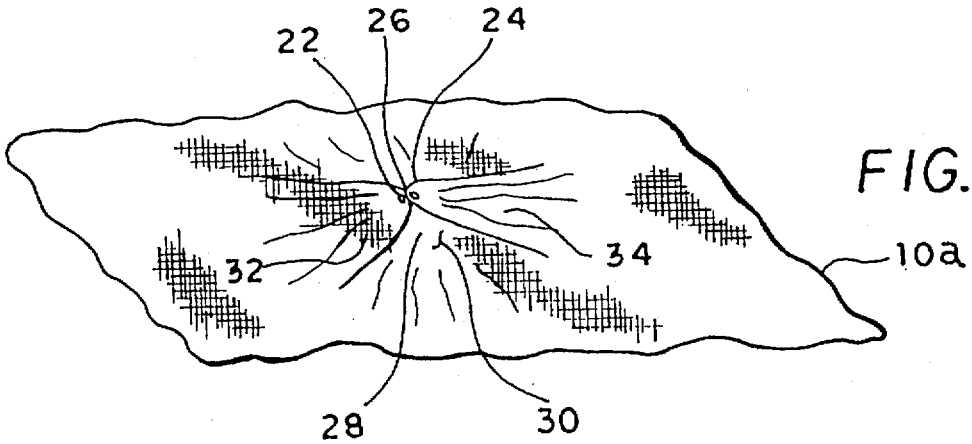
FIG. 3B is a fragmented perspective view of the stretchable gift wrap portion of FIG. 3A, showing the connection of different points of the sheet to form a trim attachment loop.
Figure 3C:
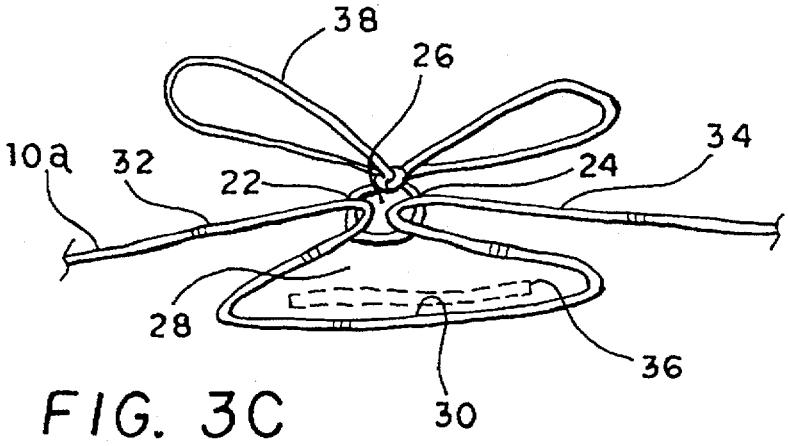
FIG. 3C is a side elevational view in section of the trim attachment loop of FIG. 3B, showing the installation of trim therewith.

The stretchable topping sheet 10 lends itself to providing further embellishments by means of the stretchable and distensible nature of the material, as shown in FIGS. 3A through 3C. The stretchable sheet may be used to form a trim attachment loop, if desired, by drawing and attaching together two separate points on the surface of the sheet. In FIG. 3A, a first point 22 and a second point 24 are lifted from a sheet 10*a* and pulled toward one another. They are drawn toward one another until they meet at a closure point 26, as shown in FIG. 3B, thus defining a closed loop 28 between the portion 30 of the material underlying the loop 28, and the overlying material portions 32 and 34 drawn toward one another as the two points 22 and 24 are drawn together to meet at the closure point 26, as shown in FIG. 3C.

Figure 4:
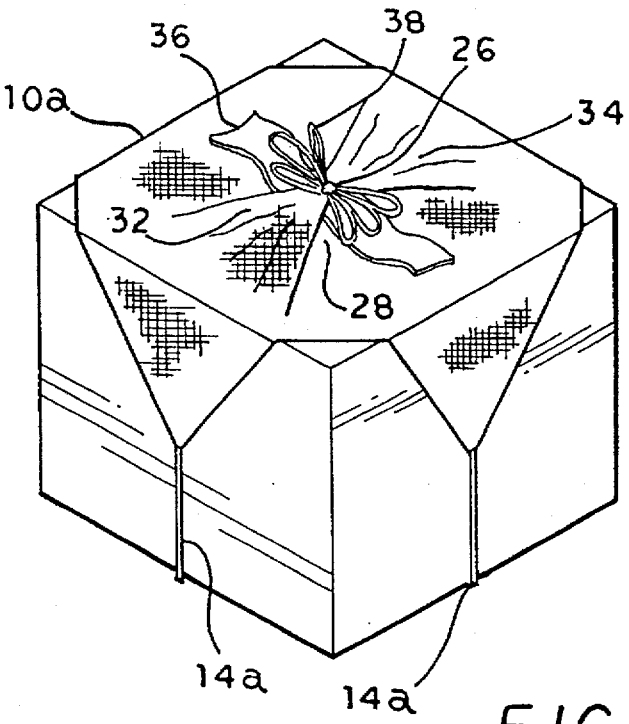
FIG. 4 is a perspective view of the wrapper topped article of FIG. 2, modified by the gathered trim holder of FIG. 3 to hold a trim article(s) therein.

A decorative ribbon 36, bow, or other article of trim may be secured through and/or around the top of the loop 28, i.e., about the closure point 26 of the two portions 32 and 34, and/or the two points 22 and 24 may be secured together at the closure point 26 by means of a decorative tie, ribbon, bow, or other decorative trim 38 as desired. Such a trimmed topping sheet 10*a*, having a ribbon 36 and bow tie trim 38 installed through the loop 28, is shown in FIG. 4. Otherwise, the topping sheet 10*a* shown wrapped about the package P2 of FIG. 4 is essentially the same as the topping sheet 10 shown wrapped about the package P of FIG. 2, with the sheet 10*a* of FIG. 4 having a pair of diagonally oppositely disposed elastic straps 14*a*, etc.

Figure 5A:
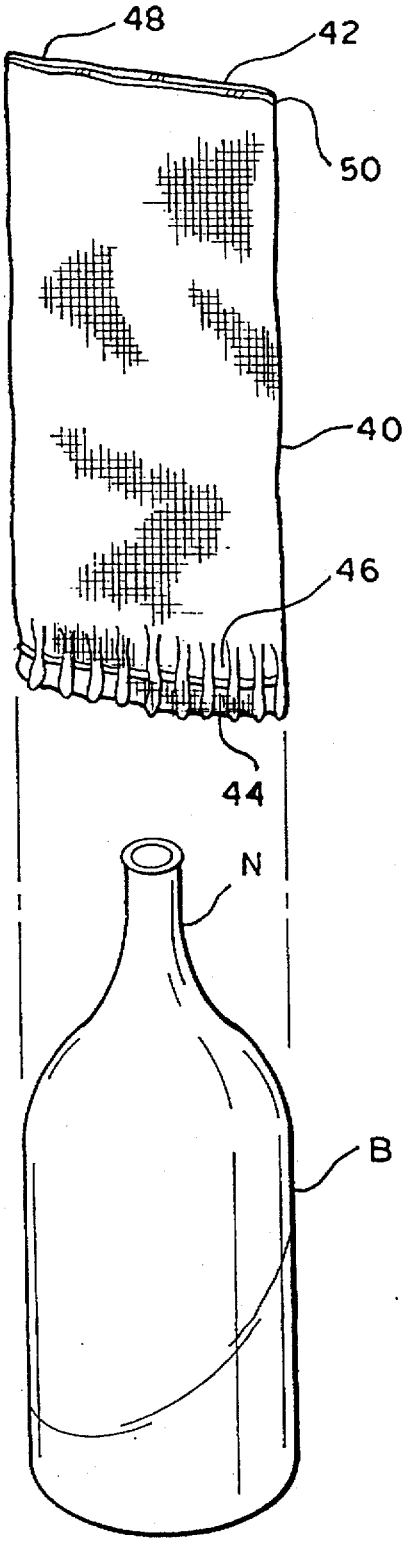
FIG. 5A is an exploded perspective view of an alternate embodiment of the present stretchable gift wrap and article to be wrapped, wherein the wrap is formed as a sleeve having a closed upper end to provide for the wrapping of an elongate article.

FIGS. 5A through 5E disclose variations on another embodiment of the present stretchable gift wrap invention, wherein a planar sheet of stretchable material having essentially the same properties as those of the topping sheets 10 and 10*a*, is used to form a sleeve 40, as shown in its basic form in FIG. 5A. The sleeve 40 is sewn or otherwise closed along one edge to form an envelope, with the upper end 42 of the sleeve 40 also being closed. The opposite lower or bottom end 44 of the sleeve 40 is left open, and may be provided with a draw string or elastic band closure 46 to secure about the bottom of an elongate article (e.g., a wine bottle B) which is wrapped therein. Thus, the sleeve 40 is well adapted to stretch over and around the bottle B to conform to its contours, with the lower open end 44 of the sleeve 40 being drawn over the bottom of the bottle B to partially envelop the bottom.

Figure 5B:
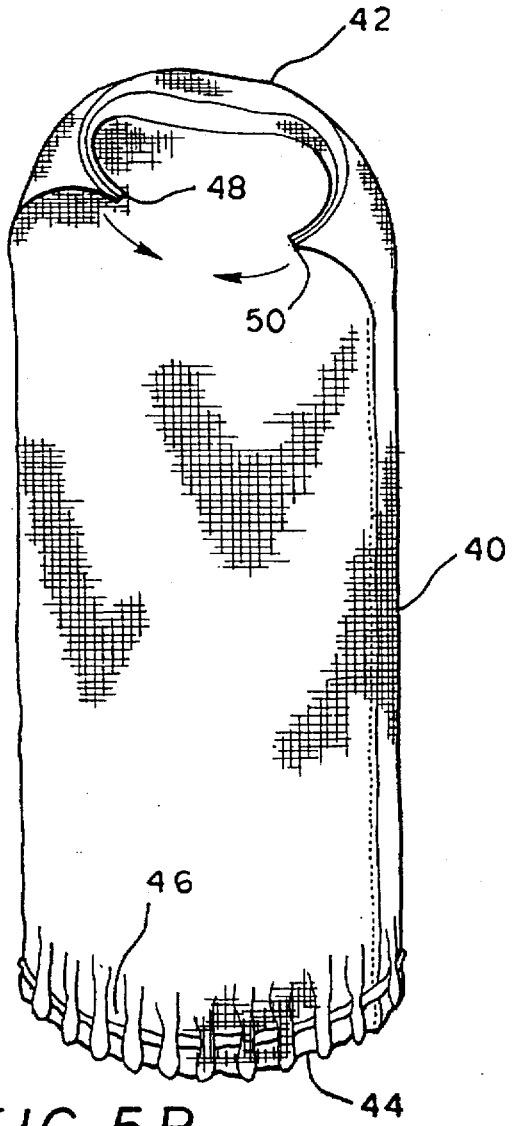
FIG. 5B is a perspective view of the wrap of FIG. 5A enclosing an article therein, showing the first step in the of the upper portion thereof to complete the wrap.

The generally rectangular configuration of the sleeve 40 in its flat state, as shown in FIG. 5A, results in opposite first and second corners, respectively 48 and 50, at the upper end 42 of the sleeve 40. It will be seen that a cylindrical article, particularly such an article with a narrow and/or tapered upper neck N, such as the wine bottle B, will result in the material of the two upper corners 48 and 50 extending from the enclosed bottle B even though the stretchable sleeve 40 is otherwise reasonably taut over the bottle B, as shown in FIG. 5B. These corners 48 and 50 may be used advantageously to provide further decoration and/or one or more trim attachment loops, as shown in FIGS. 5C through 5E and explained below.

Figure 5C:
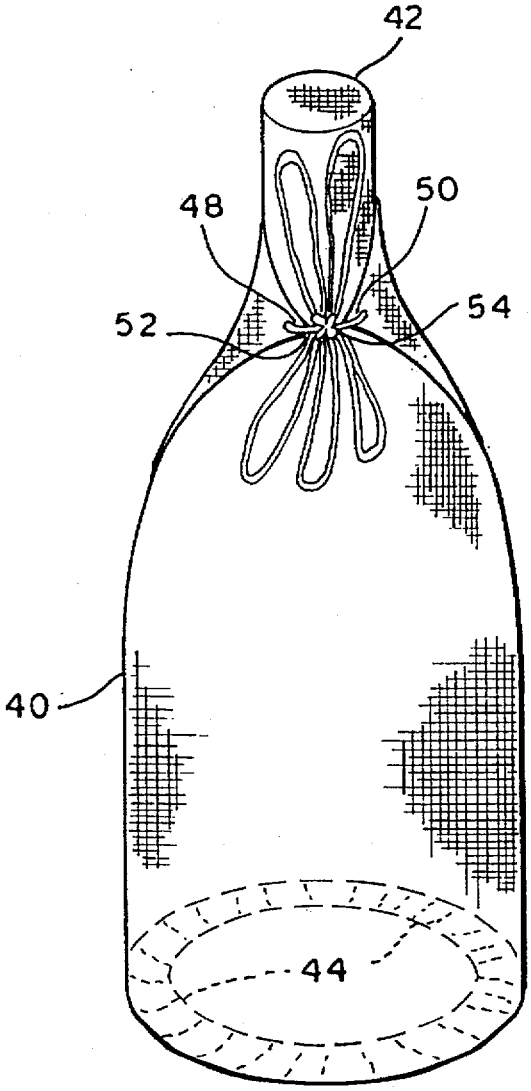
FIG. 5C is a perspective view of the wrapped article of FIG. 5B, showing the completion of the upper folds and attachment of a trim component thereto.
Figure 5D:
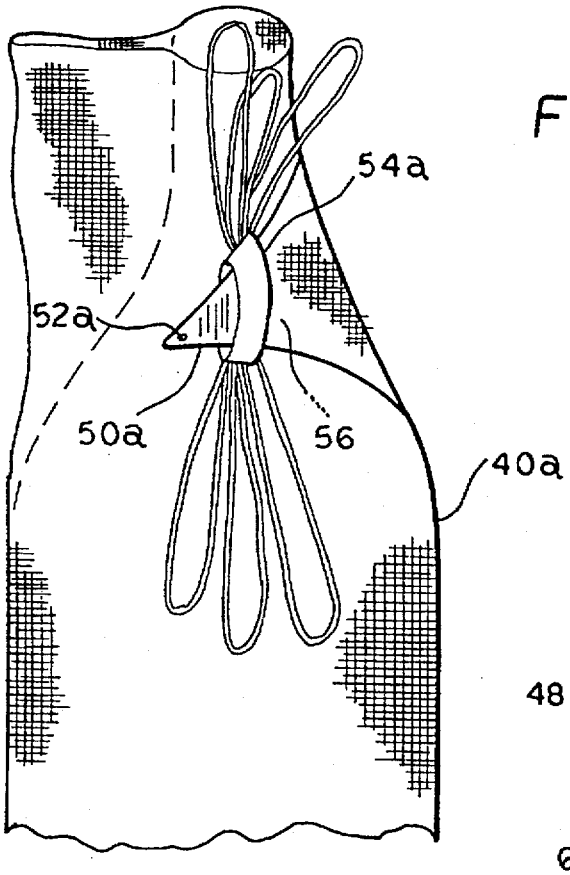
FIG. 5D is a fragmented perspective view of an alternate embodiment of the folded wrap of FIG. 5C, showing an alternative folding and trim arrangement.
Figure 5E:
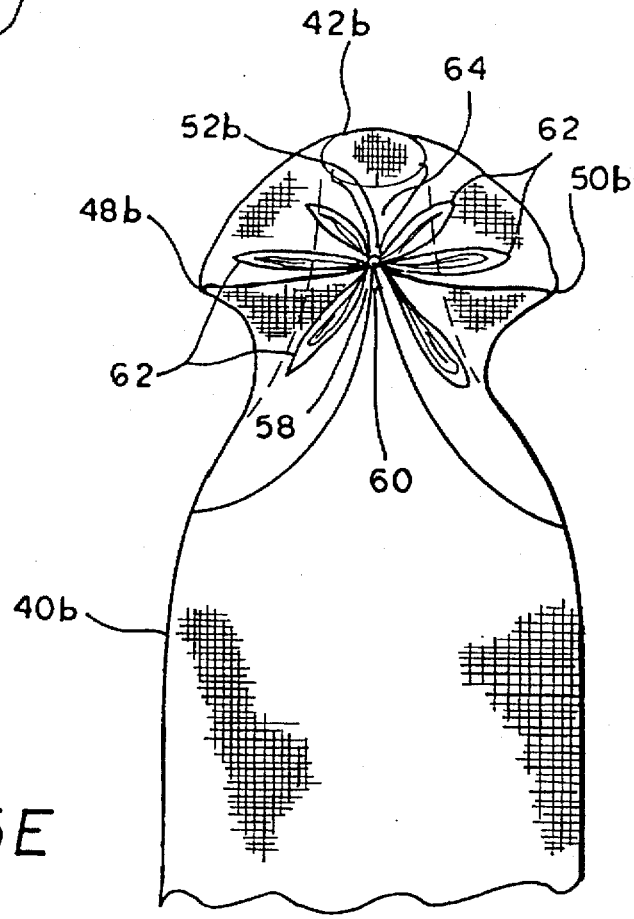
FIG. 5E is a fragmented perspective view of another alternative embodiment of the folded wrap of FIG. 5C, showing another alternative folding arrangement.

In FIG. 5C, the lower end 44 of the stretchable sleeve 40 has been drawn further downwardly and about the lower end of the bottle, to draw the sleeve 40 tightly about the bottle. (It should be noted that it is not necessary to enclose the bottom of the bottle completely, as the bottle will be resting on the otherwise exposed portion of the bottom when the bottle is upright. The securing of the lower end 44 of the sleeve 40 partially about the bottom of the bottle, serves to provide complete coverage of the otherwise exposed sides, upper portion, and neck of the bottle.)

The two upper corners 48 and 50 have been stretched, folded, and drawn forwardly and downwardly, to cause the upper portion of the sleeve 40 to conform smoothly and closely to the upper contours and neck of the bottle. The two corners 48 and 50 may be secured together at a closure point 52, as shown in FIG. 5*c*, or may be secured to separate points on the sleeve 40, as desired. The two corners 48 and 50 may be secured together by some form of trim 54 (bow, ribbon, tie, etc.), as shown in FIG. 5C, as desired.

Alternatively, one of the two corners may be left free, with only its opposite corner being secured to the upper portion of the sleeve. An example of such a configuration is shown in FIG. 5D, where the second corner 50*a* has been folded over and stretched partially across the upper portion of the sleeve 40*a* to secure to a closure point 52*a*, to form a trim attachment loop 56 between the folded over corner 50*a* material and the underlying sleeve material. A trim article 54*a* may be secured through the trim attachment loop 56 for further decoration, as desired.

A further variation on the above described theme of stretching and folding the empty corners of the sleeve embodiment over to form a decorative topping for the wrap, is shown in FIG. 5E. In this figure, the sleeve 40*b*, having a basic construction essentially identical to the sleeves 40 and 40*a* discussed further above, is drawn tautly over a bottle with the upper end 42*b* of the sleeve fitting closely over the top of the bottle. However, rather than drawing the two upper corners 48*b* and 50*b* together, two intermediate points 58 and 60 located somewhat below the respective upper corners 48*b* and 50*b* are drawn together and secured to one another (but not to the underlying portion of the sleeve 40*b*) at a closure point 52*b*. The upper corners 48*b* and 50*b* are then folded outwardly and partially inverted, with the material gathered together at the two intermediate points 58 and 60 forming a series of decorative folds 62 radiating outwardly from the joined intermediate points 58/60. As in the other embodiments and variations discussed above, a decorative article of trim (not shown) may be secured through the trim attachment loop 64 formed by joining the two intermediate points 58/60, if desired.

Thus far, only sleeve embodiments developed from a stretchable sleeve having a closed upper end, have been discussed. However, it is also possible to form stretchable gift wrap or the like, using a stretchable sleeve having an open upper end. An example of such an open upper end sleeve embodiment, and a completed stretched wrap of an elongate article using such an open upper ended sleeve, is shown respectively in FIGS. 6A and 6B.

Figure 6A:
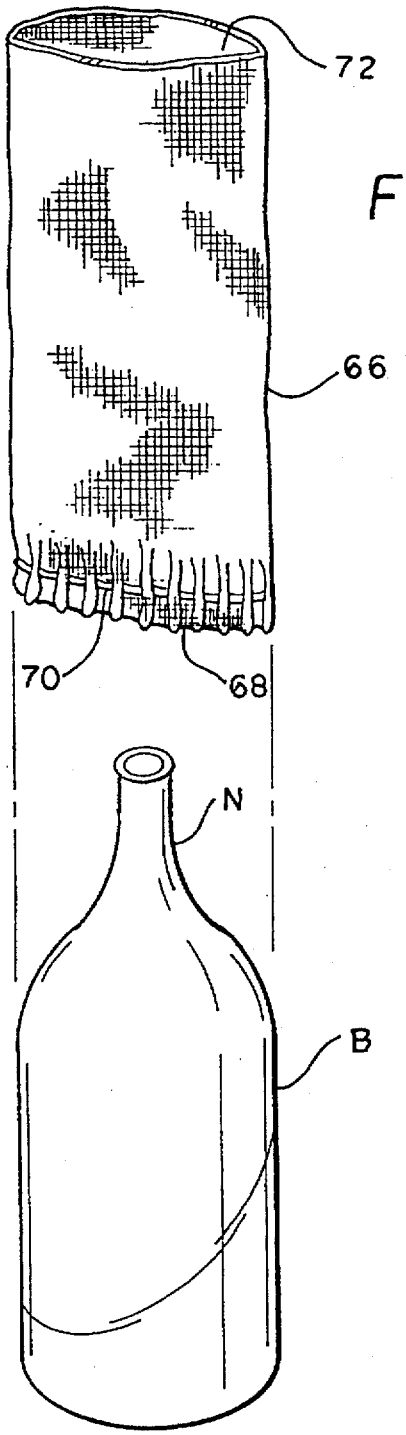
FIG. 6A is an exploded perspective view of an alternate embodiment stretchable sleeve having openings at both ends thereof, and an elongate article to be wrapped therein.

In FIG. 6A, a stretchable sleeve 66 formed of a spandex or other suitable material as in the other embodiments discussed above, is provided with an open lower end 68 with a draw string or elastic closure 70, as in the sleeves **40/40*a*/40*b* discussed further above. However, the sleeve 66 also includes an open upper end 72, unlike the closed upper ends of the sleeves 40/40*a*/40*b*. This open upper end 72 of the sleeve 66 may be passed downwardly about the neck of a bottle B and secured therearound, to expose the neck and top of the bottle above the wrapped upper end 72 of the sleeve 66**.

The lower end 68 of the open upper ended sleeve 66 is secured about the base of the bottle in the same manner as in the closed upper end sleeves **40/40*a*/40*b* discussed further above. This leaves the neck N of the bottle protruding above the open upper end 72 of the sleeve 66, with the opposite first and second upper corners 74 and 76 extending from the narrower upper portion of the bottle, somewhat as shown with the sleeve 40 in FIG. 5B. The two upper corners 74/76 are drawn outwardly, and then folded together over the adjacent upper end or portion of the sleeve 66 and joined at a common closure point 78 to form a trim attachment loop 80 between the joined upper corners 74/76 and the underlying upper portion of the sleeve 66 material, similar to the configuration shown for the completed wrapped sleeve 40 of FIG. 5C. A trim article 82 may be secured therearound, or used to secure the two corners 74/76 together as in other wraps discussed above. However, the upper portion one the bottle neck N, with any decorative foil, label, etc. thereon, remains exposed using the open upper ended sleeve 66**.

Figure 6B:
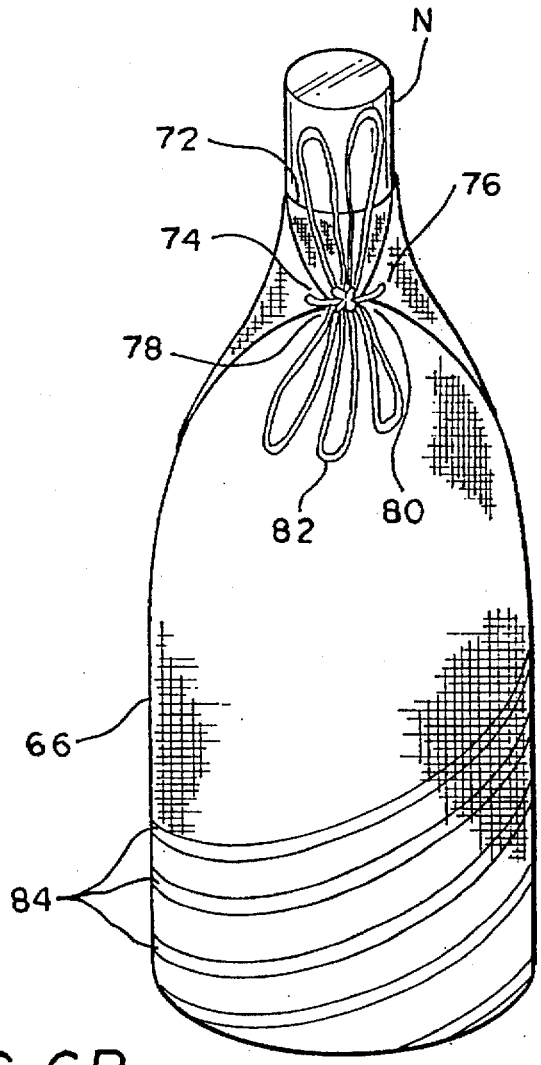
FIG. 6B is a perspective view of the completed wrapped article of FIG. 6A, showing the exposed neck of the article through the open upper end of the wrap.

While the only embodiment disclosed in the FIG. 6 series comprising FIGS. 6A and 6B is a double folded sleeve upper end similar to that shown in FIG. 5C, it should be noted that the other upper end fold embodiments shown in FIGS. 5D and 5E may also be accomplished using the open upper ended sleeve 66. These open upper end fold embodiments are not shown in the drawings to avoid redundancy, but should be apparent to those who may practice the present invention, after a review of FIGS. 5C, 5D, 5E, and 6B. It should also be noted that the various sleeve embodiments of the FIG. 5 series and FIG. 6 series may include some form of decorative pattern(s) disposed thereon (e.g., the spiral pattern 84 of FIG. 6B), as in the topping sheet 10 shown in FIG. 2.

Figure 7:
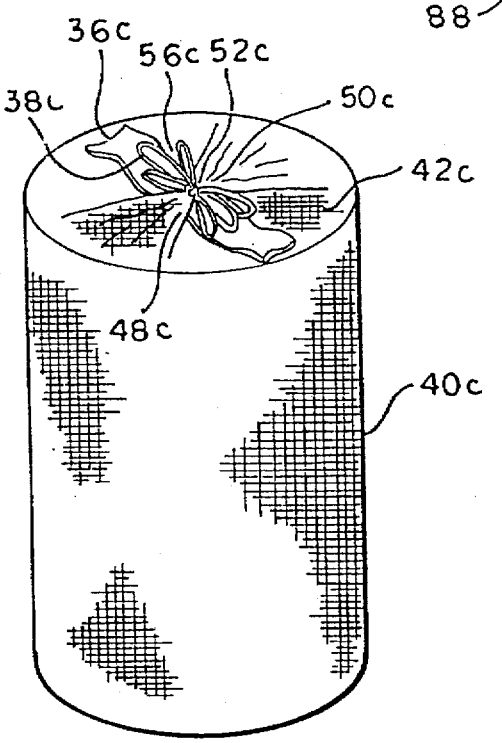
FIG. 7 is a perspective view of a cylindrical article wrapped with the stretchable sleeve of FIG. 5A, and including a gathered trim holder portion as shown in FIG. 4.

FIG. 7 discloses a further application of the closed upper end sleeve configuration, wherein a sleeve **40*c* having a closed upper end 42*c* is used to cover a generally cylindrical article. The sleeve 40*c* may include an open lower end and partial closure means therefor (not shown, but similar to that disclosed in FIGS. 5A through 5C and 6A), and is drawn downwardly about the article to be wrapped therein. The closed upper end 42*c* is drawn and distended tautly over the upper end of the article. The first and second upper corners 48*c* and 50*c* of the sleeve 40*c* may not be drawn into close fitting contact with the upper end of the cylindrical article, due to the flat nature of the sleeve 40*c* in its undistended state. However, these corners 48*c*/50*c* may be drawn and secured together at a closure point 52*c* at the top of the article, to form a trim attachment loop 56*c*** therebeneath.

At this point, an optional additional trim article(s) may be secured between the two corners **48*c*/50*c*, and/or through the trim attachment loop 56*c*. A bow or ribbon 36*c*, tie 38*c*, or other trim means may be secured to the top of the package as described above. Alternatively, it will be seen that the above described closure point 52*c*, trim attachment loop 56*c*, and any articles of trim 36*c*/38*c*, may be shifted to an asymmetric point somewhere on the top or upper side of the wrapped article, due to the elastic nature of the stretchable wrapping sleeve 40*c***. Such asymmetric positioning of the corners of any of the sleeves disclosed herein, or gathered portions used to form a trim attachment loop, may be accomplished with any of the appropriate embodiments described herein. (Such asymmetric positioning is not shown in the drawings in order to simplify the numerous drawing figures presented herein.)

Figure 8A:
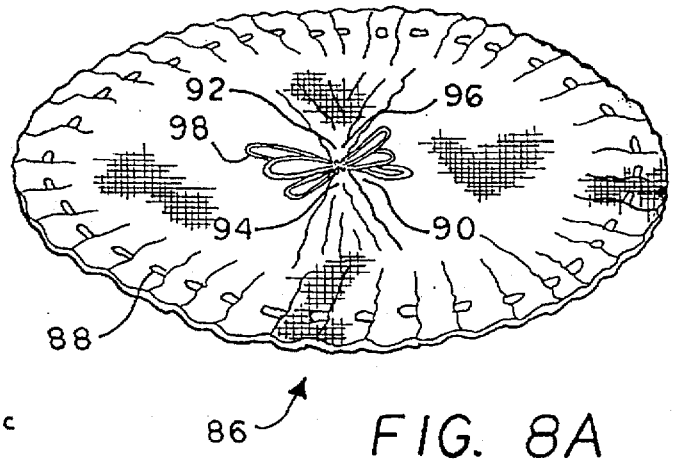
FIG. 8A is a perspective view of an alternate embodiment of the stretchable wrap of FIG. 1 with the trim attachment arrangement of FIG. 4, wherein a peripheral closure band is provided.
Figure 8B:
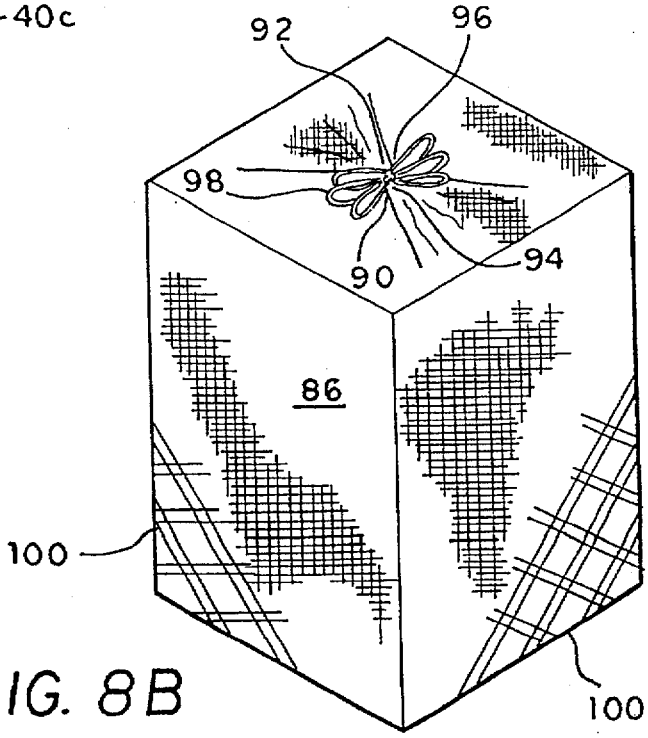
FIG. 8B is a perspective view of the stretchable gift wrap sheet of FIG. 8A wrapped about an elongate article.

FIGS. 8A and 8B provide views of a further embodiment of the present invention, comprising a wrapping sheet 86 formed of the same material as described above and used in other embodiments of the present invention (spandex, etc.). The wrapping sheet 86 has a peripheral closure band 88 thereabout, similar to the partial elastic or draw string closure means 46 and 70 of the embodiments of FIGS. 5B and 6A. The wrapping sheet 86 is placed over and around the article, with the peripheral closure band 88 being drawn at least partially closed about the lowermost portion of the article. This secures the wrapping sheet 86 over the upper portion of the article, with the wrapping sheet 86 conforming stretchably and closely to the contours of the article.

If desired, a trim attachment loop 90 may be formed in the manner described above for other embodiments, by gathering a first and a separate second point, respectively 92 and 94, and joining them together at a closure point 96. An article of trim 98 (ribbon, bow, tie, etc.) may be used to secure the two points 92/94 together, and/or secured about the closure point 96 and through the trim attachment loop 90, as in other trim attachment embodiments discussed further above.

It will be seen that the above described wrapping sheet 86 embodiment may be formed in a generally circular shape, as shown in FIG. 8A, or may alternatively be formed in virtually any two dimensional shape desired. In any event, the stretchable and distensible nature of the material, along with the closure band 88, enables the wrapping sheet 86 to be secured smoothly about an article of virtually any shape. As in the various other embodiments discussed above, some form of decorative pattern 100 (e.g., the cross hatched diagonal stripes shown on the completed wrap of FIG. 8B) may be provided as desired.

In summary, the above described stretchable gift wrap, in each of its embodiments, will be seen to provide a most attractive means of wrapping various articles of virtually any regular or irregular shape. While the topping sheet 10 or other forms of the present invention provide a most attractive gift wrap in and of themselves, the gathering of separate points on the stretchable sheets to form a trim attachment loop, provides even further enhancement to the appearance of any article wrapped using the present gift wrap.

Due to the reusable nature of the present stretchable gift wrap, greater economy is provided than with conventional paper or plastic sheet gift wraps (particularly more expensive wraps having highly reflective metallic, embossed, or other costly finishes), with such conventional wraps being discarded after a single use due to their being torn and wrinkled when removed from the package or gift. Even in the event that such conventional wraps are saved, they are seldom useful for a second wrapping due to the creases and folds which are permanently formed in such wraps when first used.

Accordingly, the present stretchable gift wrap will be seen to be of great value to persons who wish to wrap various gifts or other articles for any occasion. The present wrap provides a most elegant appearance, particularly when a trim attachment loop is formed therein and trim is added, which is simply unavailable with conventional wraps, regardless of their cost and finish.

It is to be understood that the present invention is not limited to the sole embodiments described above, but encompasses any and all embodiments within the scope of the following claims.

I claim:

1. Stretchable gift wrap, comprising:

a sleeve of finely woven, generally opaque elastic fabric material adapted to stretch to substantially twice its unstretched dimension in all directions, said sleeve including a lower open end and a closed upper end having opposite first and second corners, said second corner being secured to said upper end to form a first trim attachment loop, and a second trim attachment loop formed by folding and stretchably drawing said first corner of said upper end of said sleeve partially across said upper end thereof, with said first corner and said second corner being secured together.

2. The stretchable gift wrap of claim 1, including:

an article of trim secured to said sleeve by said first trim attachment loop.

3. The stretchable gift wrap according to claim 1, wherein:

said sleeve is formed of spandex fabric material.

4. The stretchable gift wrap according to claim 1, including:

at least one decorative pattern disposed upon said sleeve.

5. Stretchable gift wrap comprising:

a sleeve of finely woven, generally opaque elastic fabric material adapted to stretch to substantially twice its unstretched dimension in all directions, said sleeve including a lower open end and an open upper end adapted to be secured about an article with the article having an upper portion extending from said open upper end of said sleeve, said open upper end has opposite first and second corners, said second of said corners being secured to said upper end to form a first trim attachment loop in said sleeve, and a second trim attachment loop formed by folding and stretchably drawing said first of said corners of said upper end of said sleeve partially across said upper end thereof, with said first corner and said second corner being secured together.

6. The stretchable gift wrap of claim 5, including:

an article of trim secured to said sleeve by said first trim attachment loop.

* * * * *